US010926392B2

(12) United States Patent
Moreno

(10) Patent No.: US 10,926,392 B2
(45) Date of Patent: Feb. 23, 2021

(54) CONSTRUCTION AND DEMOLITION BAR AND METHOD

(71) Applicant: Ricardo Moreno, Hutchinson, MN (US)

(72) Inventor: Ricardo Moreno, Hutchinson, MN (US)

( * ) Notice: Subject to any disclaimer, the term of this patent is extended or adjusted under 35 U.S.C. 154(b) by 383 days.

(21) Appl. No.: 15/158,067

(22) Filed: May 18, 2016

(65) Prior Publication Data

US 2016/0339575 A1 Nov. 24, 2016

Related U.S. Application Data

(60) Provisional application No. 62/164,050, filed on May 20, 2015.

(51) Int. Cl.
*B25C 11/00* (2006.01)
*B66F 15/00* (2006.01)

(52) U.S. Cl.
CPC ..... *B25C 11/00* (2013.01)

(58) Field of Classification Search
CPC ..... B25C 11/00
See application file for complete search history.

(56) References Cited

U.S. PATENT DOCUMENTS 2,772,587 A * 12/1956 Woodring ..... B21D 7/063 72/458
6,752,380 B1 * 6/2004 Taylor ..... B25C 11/00 254/21
D752,940 S * 4/2016 Deng ..... D8/81
2005/0062026 A1 * 3/2005 Holcomb ..... B25C 11/00 254/25
2013/0283541 A1 * 10/2013 Cridlebaugh ..... B25F 1/006 7/144

* cited by examiner

*Primary Examiner* — John C Hong
(74) *Attorney, Agent, or Firm* — Schwegman Lundberg & Woessner, P.A.

(57) ABSTRACT

A construction and demolition bar and associated methods of use are shown. In one example, a construction and demolition bar is shown that includes a pulling fork located at an end of an arced portion. In one example the pulling fork is oriented at substantially 90 degrees from a rotation plane defined by the bar and the arced portion. In one example, a notch of the pulling fork is within a width of the arced portion, to provide stable pulling force for removing fasteners.

7 Claims, 2 Drawing Sheets

CONSTRUCTION AND DEMOLITION BAR AND METHOD

RELATED APPLICATION

This application claims priority to U.S. Provisional Patent Application No. 62/164,050, entitled "CONSTRUCTION AND DEMOLITION BAR AND METHOD," filed on May 20, 2015, which is incorporated herein by reference in its entirety.

TECHNICAL FIELD

This invention relates to tools for construction and demolition and their associated methods. In one example, this invention relates to a tool for pulling nails and/or staples from wood or other construction materials.

BACKGROUND

Pulling staples from wood or other construction materials can be difficult for a number of reasons. In one example, an orientation of a staple and of a base material such as lath or other cross member can make removal of staples difficult.

DETAILED DESCRIPTION

Figure 1:
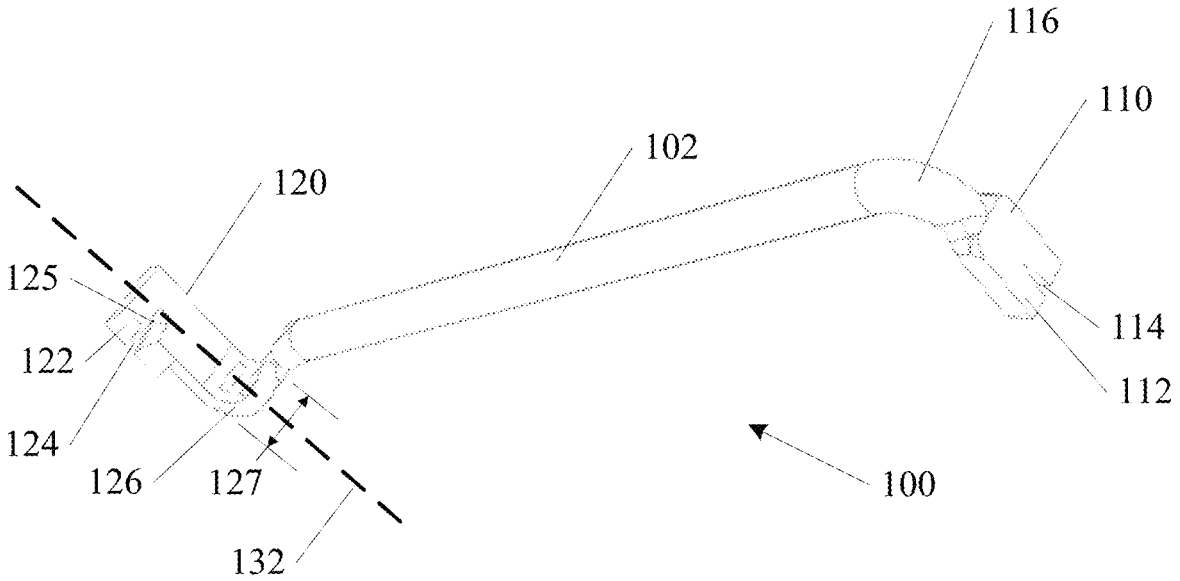
FIG. 1 shows an isometric view of a construction and demolition bar according to an example of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention.

FIG. 1 shows one example of a construction and demolition bar 100. The demolition bar 100 includes an elongated bar 102 with a first end 120 and a second end 110. An arced portion 126 is shown at the first end 120. A pulling fork 122 is further shown at the end of the arced portion 126. The pulling fork 122 is oriented at substantially 90 degrees from a rotation plane defined by the elongated bar 102 and the arced portion 126. The orientation will be described in more detail below in discussion of FIGS. 2 and 3.

In one example, the pulling fork includes a notch 124 with a root 125 at the end of the notch. The arced portion 126 has a width 127 as shown in FIG. 1. In the example of FIG. 1, the root 125 of the notch 124 lies within the width 127 of the arced portion 126. Line 132 of FIG. 1 illustrates where the root 125 of the notch 124 lies within the width 127 of the arced portion 126. One advantage of having the root 125 of the notch 124 within the width 127 of the arced portion 126 includes an improved ability to pull staples from a workpiece, such as a wall stud or cross member.

In one example, as illustrated in FIG. 1, the demolition bar 100 further includes a second arced portion 116 located at the second end 110 of the elongated bar 120. A second pulling fork 112 may be included having a second notch 114. In construction and/or demolition operations several different scenarios may be encountered when pulling fasteners such as nails, screws, staples, etc. It may be advantageous to have both the first fork 122 and the second fork 112 at different orientations relative to the elongated bar 102 and the arced portions 126, 116. In this way a variety of pulling scenarios may be addressed with a single demolition bar 100.

Although a second fork 112 and arced portion 116 are shown in the example of FIG. 1, the invention is not so limited. Other configurations may not include any additional tooling at the second end 110 of the elongated bar 102. In other examples a different type of fork may be included at the second end 110 of the elongated bar 102. In other examples a different type of tooling other than a fork, such as a chisel, hammer head, etc. may be included at the second end 110 of the elongated bar 102.

Figure 2:
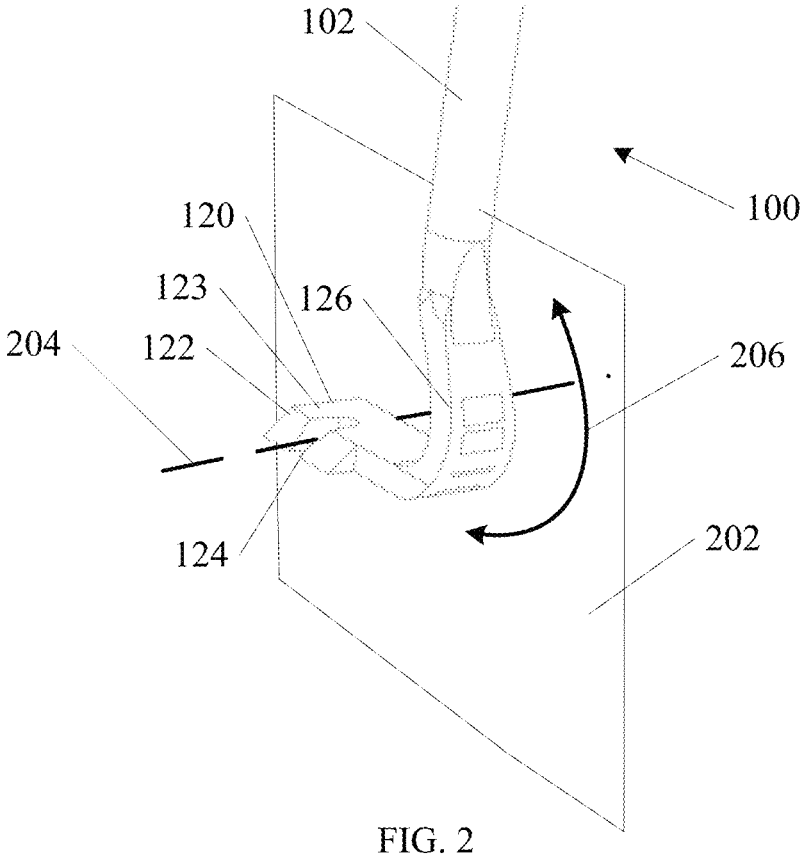
FIG. 2 shows an close up view of one end of a construction and demolition bar according to an example of the invention.

FIG. 2 shows a close up illustration of the first end 120 of the demolition bar 100 from FIG. 1. The pulling fork 122 is shown in relation to a rotation plane 202 defined by the elongated bar 102 and the arced portion 126. In operation, the demolition bar 100 is rotated within the rotation plane 202 as indicated by arrows 206. A direction of the pulling fork 122 is indicated by line 204, which runs parallel to tines of the fork 122. In the example shown, the pulling fork 122 is oriented at substantially 90 degrees from the rotation plane 202. A left tine of the pulling fork 122 includes a top surface 123 with space for legs of a staple on either side, as illustrated in FIG. 3.

Figure 3:
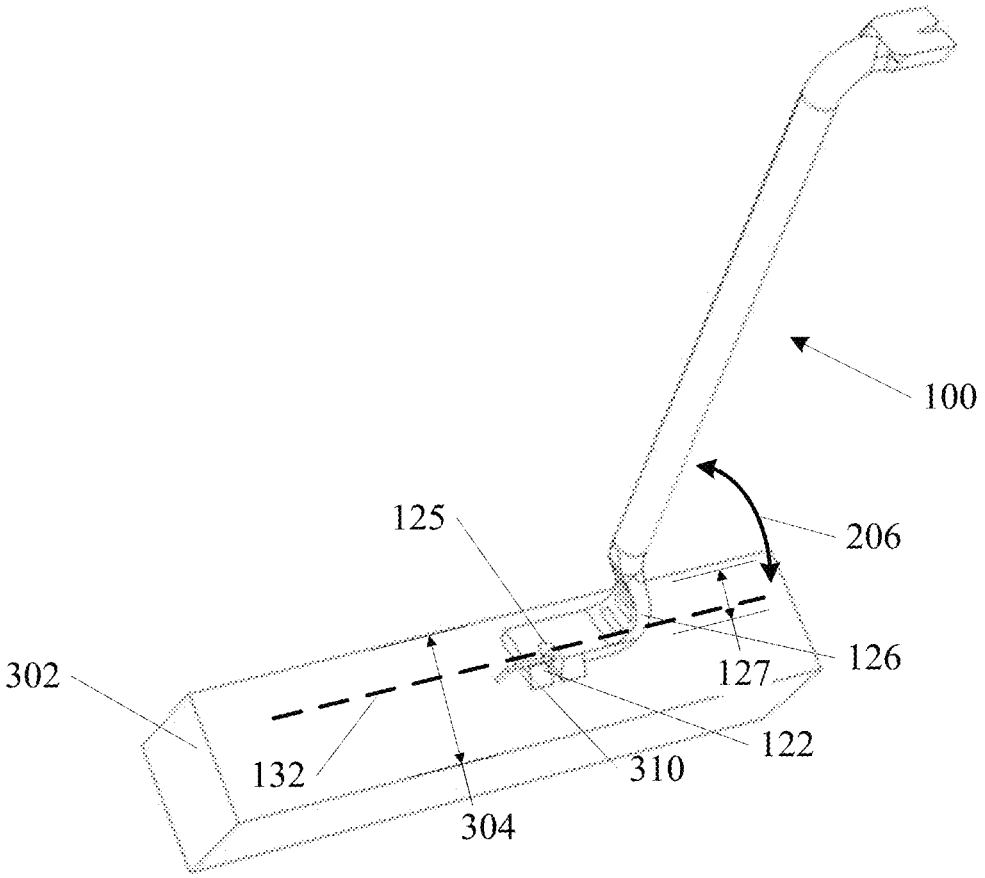
FIG. 3 shows a construction and demolition bar in operation according to an example of the invention.

FIG. 3 shows an example of the demolition bar 100 in operation, pulling a staple 310 from a workpiece 302. Although a staple is used as an example fastener that may be pulled from a workpiece using the demolition bar 100, the invention is not so limited. Other fasteners including, but not limited to, nails, screws, tacks, etc. are removable using embodiments of the present invention.

The pulling fork 122 is again shown with the root 125 of the notch 124 lying within the width 127 of the arced portion 126. As previously illustrated in FIG. 1, the root 125 of the notch 124 lies along line 132, which is shown within the width 127 of the arced portion 126. The Example workpiece 302 is shown having a width 304. Both the workpiece 302 and the staple are shown lying parallel to the line 132.

One problem with conventional pulling forks is that with a staple oriented parallel to the workpiece, as shown in FIG. 3, there is not sufficient width 304 to provide a reaction surface against an arced member. In order to pull a staple using a pulling fork, a tine of the fork is inserted under a middle portion of the staple, and needs to be inserted in a direction substantially perpendicular to the staple. When a conventional pulling fork is inserted perpendicular to a staple, frequently, the arced portion cannot be positioned to press against the workpiece to provide a reaction force for extraction of the staple.

Using configurations described in the present disclosure, such as the example in FIG. 3, when a tine of the fork 122 is inserted under the staple 310, the arced portion 126 is oriented parallel to the workpiece 302. In this configuration of FIG. 3, the arced portion 126 rests firmly on the workpiece, and provides a good reaction force for extraction of the staple 310.

In addition, because the root 125 of the notch 124 is within the width 127 of the arced portion 126, the demolition bar 100 will not tend to twist during the extraction operation. If the root 125 falls outside the width 127 of the arced portion, the bar may be less effective due to the tendency of the bar to twist out of the rotation plane 202.

Figure 4:
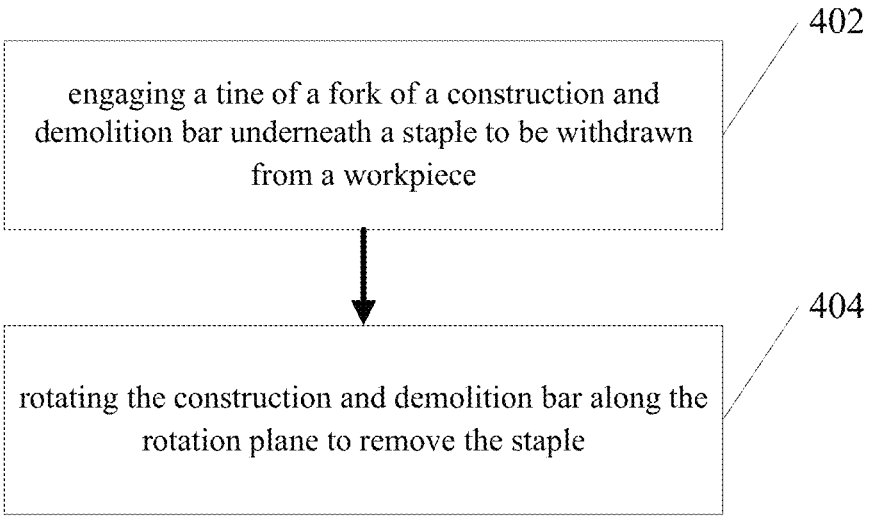
FIG. 4 shows a method of pulling a staple according to an example of the invention.

FIG. 4 shows an example method of removing a fastener using a demolition bar as disclosed in examples above. In operation 402 if FIG. 4, a tine of a fork of a construction and demolition bar is engaged underneath a staple to be withdrawn from a workpiece. In operation 404, the demolition bar is rotated along the rotation plane to remove the staple.

While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A construction and demolition bar, comprising:

an elongated bar;

an arced portion located at a first end of the elongated bar, the arced portion having a width;

a pulling fork including a pair of tines, each tine in the pair of tines including a ramped front end, and wherein only one tine in the pair of tines includes a top surface adapted to pry a staple, the top surface located within the width of the arced portion, the pulling fork located at the first end of the arced portion, wherein the pulling fork and tines are oriented at substantially 90 degrees from a rotation plane defined by the elongated bar and the arced portion; and a notch of the pulling fork, wherein a root of the notch is within the width of the arced portion.

2. The construction and demolition bar of claim 1, wherein the arced portion is substantially flat.

3. The construction and demolition bar of claim 1, wherein the elongated bar is substantially round.

4. The construction and demolition bar of claim 1, wherein the arced portion defines approximately 90 degrees between the elongated bar and the pulling fork.

5. The construction and demolition bar of claim 1, further including a second pulling fork located at a second end of the elongated bar.

6. The construction and demolition bar of claim 5, wherein the second pulling fork is oriented substantially within the rotation plane defined by the elongated bar and the arced portion.

7. The construction and demolition bar of claim 6, wherein the second pulling fork is coupled to the elongated bar with a second arced portion that defines approximately 90 degrees between the elongated bar and the second pulling fork.

* * * * *